United States Patent [19]

Brokaw

[11] Patent Number: 4,622,512

[45] Date of Patent: Nov. 11, 1986

[54] BAND-GAP REFERENCE CIRCUIT FOR USE WITH CMOS IC CHIPS

[75] Inventor: Adrian P. Brokaw, Burlington, Mass.

[73] Assignee: Analog Devices, Inc., Norwood, Mass.

[21] Appl. No.: 700,192

[22] Filed: Feb. 11, 1985

[51] Int. Cl.[4] ..... G05F 3/20

[52] U.S. Cl. ..... 323/313; 323/316; 323/907

[58] Field of Search ..... 323/313-316, 323/907; 307/296 R, 297

[56] References Cited

U.S. PATENT DOCUMENTS 4,263,519 4/1981 Schade, Jr. ..... 323/314 X 4,317,054 2/1982 Caruso et al. ..... 323/313 X

*Primary Examiner*—Peter S. Wong

*Attorney, Agent, or Firm*—Parmelee, Bollinger & Bramblett

[57] ABSTRACT

A band-gap reference circuit having a pair of transistors operated at different current densities to produce a positive temperature coefficient (TC) signal proportional to the $\Delta V_{BE}$ of the two transistors and combined with a negative TC voltage derived from the $V_{BE}$ of one of the transistors to produce a composite signal substantially invariant with temperature. The $\Delta V_{BE}$ signal component is increased in magnitude by connecting resistor string bias circuit to each of the transistors, to effectively multiply the $V_{BE}$ of each transistor, and thereby multiply the $\Delta V_{BE}$ signal. The composite signal is sensed in the emitter circuits of the two transistors, so that it is unnecessary to access the collectors of the transistors, thereby making it readily possible to use the circuit with CMOS IC devices.

10 Claims, 5 Drawing Figures

BAND-GAP REFERENCE CIRCUIT FOR USE WITH CMOS IC CHIPS

BACKGROUND OF THE INVENTION

1. Field of the Invention

This invention relates to reference circuits of the band-gap type. Such circuits are generally used as voltage references, but do find other applications such as threshold detectors. The present invention particularly relates to band-gap circuits which are suited for use with CMOS integrated-circuit (IC) chips.

2. Description of the Prior Art

Band-gap voltage regulators have been used for a number of years for developing reference voltages which remain substantially constant in the face of temperature variations. Such circuits generally develop a voltage proportional to the difference between base-to-emitter voltages ($\Delta V_{BE}$) of two transistors operated at different current densities. This voltage will have a positive temperature coefficient (TC), and is combined with a $V_{BE}$ voltage having a negative TC to provide the output signal which varies only a little with temperature changes. Reissue U.S. Pat. RE. No. 30,586 (A. P. Brokaw) shows a particularly advantageous band-gap voltage reference requiring only two transistors.

Band-gap reference circuits have primarily been employed in bipolar ICs. Efforts have been made to adapt such references for CMOS ICs, but significant problems have been encountered in those efforts. As a result, the devices proposed for CMOS have suffered important defects, particularly undue complexity.

One serious problem results from the fact that the $\Delta V_{BE}$ voltage is quite small (e.g. less than 100 mV), so that it must be amplified quite a bit to reach a value suitable for reference purposes. Such amplification is inherent in a band-gap circuit such as shown in U.S. Pat. RE. No. 30,586 referred to above, because the $\Delta V_{BE}$ signal is taken from the collectors of the two transistors. In a CMOS chip made by the usual processes, however, the bipolar transistors available for voltage reference purposes are parasitic transistors, the collectors of which cannot be independently accessed for voltage sensing purposes. In such devices, therefore, the $\Delta V_{BE}$ voltage will not automatically be amplified by the transistors from which it is developed.

Moreover, the MOS amplifiers on a CMOS chip have relatively large offset voltages, so that the offset after substantial amplification will show up as a large error compared to the $\Delta V_{BE}$ signal component. For example, to develop a reference voltage of around 5 volts, a 20 mV offset in an amplifier (or comparator) could show up as a 0.5 volt error referred to output or threshold.

Proposals have been made to solve this problem, including various compensation arrangements. However, the resulting devices have been too complex to provide a really satisfactory solution to the problem.

SUMMARY OF THE INVENTION

In a preferred embodiment of the invention to be described hereinafter, two transistors are operated at different current densities to produce a $\Delta V_{BE}$ signal. This signal is detected at the emitter circuits of the transistors. Resistor-string $V_{BE}$ multiplier circuits are connected to the bases of both transistors. This multiplies not only the $V_{BE}$ voltages but also the $\Delta V_{BE}$ signal. This arrangement makes it possible to produce an effective $\Delta V_{BE}$ of over 400 mV with a very simple circuit adapted for use with CMOS chips.

Still other objects, aspects and advantages of the invention will in part be pointed out in, and in part apparent from, the following description of preferred embodiments considered together with the accompanying drawings.

DETAILED DESCRIPTION OF PREFERRED EMBODIMENTS OF THE INVENTION

Figure 1:
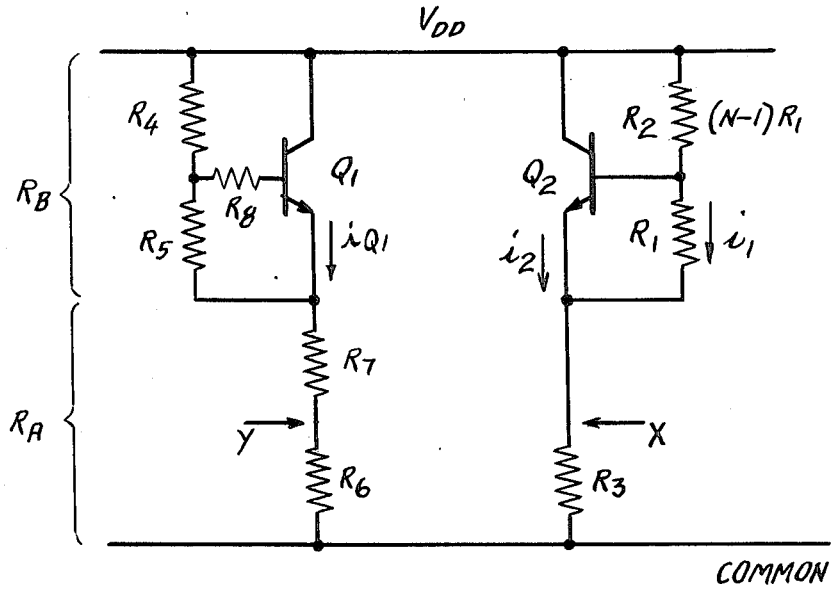
FIG. 1 is a circuit diagram showing an embodiment of the invention used for theshold detection.

Referring first to FIG. 1, the threshold detector comprises a pair of transistors $Q_1$ and $Q_2$ operated at different current densities. For that purpose, the transistor emitter areas will be unequal in a predetermined ratio (na:a). The collectors of the transistors are connected directly to the supply line $V_{DD}$ and the emitters are connected to common through respective resistor circuits $R_3$ and $R_6$, $R_7$.

The bases of the transistors $Q_1$ and $Q_2$ are connected to respective resistor strings $R_4/R_5$ and $R_1/R_2$ between the collector and emitter of each transistor, with the ratio $R_1$ to $R_2$ matched to the ratio of $R_5$ to $R_4$. Such resistor arrangement provides in known fashion for $V_{BE}$ multiplication proportional to the ratio of resistor values. For example, with $V_{BE2}$ appearing across resistor $R_1$ (and assuming the base current of $Q_2$ is not significant) the voltage across $R_2$ will be $(R_2/R_1)\ V_{BE2}$.

Thus the total voltage from the top of $R_1$ to the emitter of $Q_2$ will be $(1+R_2/R_1)\ (V_{BE2})$ or $NV_{BE2}$, with N defined as $1+R_2/R_1$. Similarly, the voltage from the top of $R_4$ to the emitter of $Q_1$ will be N times $V_{BE1}$. This latter voltage will be different from the corresponding voltage at $Q_2$, however, since $Q_1$ will operate at a different current density and will have a different $V_{BE}$ at the design center condition.

With properly selected circuit values and using transistors which maintain their logarithmic $V_{BE}$ performance over the full temperature and current ranges expected, the circuit will produce between the points X—Y a differential voltage which passes through zero when the supply voltage $V_{DD}$ reaches a predetermined voltage $V_T$. Increasing $V_{DD}$ above $V_T$ makes X—Y go positive; decreasing it makes X—Y go negative. By connecting a comparator to the points X—Y, the circuit becomes an effective threshold detector. Moreover, the threshold set value $V_T$ will be substantially unaffected by temperature changes.

In selecting the circuit values, the following procedure may be followed:

$V_T$ Choose $V_T$, the voltage to be detected on $V_{DD}$ $V_G$ Determine $V_G$, the effective band-gap voltage for the actual devices to be used. (This is determined by the nominal temperature slope extrapolated to 0° K.)

N Calculate $N=V_T/V_G$ $i_2$ Choose $i_2$, the nominal operating current for $Q_2$ at the design center temperature with $V_{DD}=V_T$.

$i_1$ Choose the current in the $R_1$, $R_2$ string (neglect base current) at the design center condition.

$V_{BEO}$ Determine $V_{BEO}$, the nominal base emitter voltage present on $Q_2$ when biased by $i_2$ at the design center. (Collector base voltage will be about $(N-1)\ V_{BEO}$).

$J_R$ Choose $J_R=J_2/J_1$ the actual current density ratio to be maintained between $Q_2$ and $Q_1$.

$I_R$ Choose $I_R=i_2/i_{Q1}$ the ratio of currents to be maintained in $Q_2$ and $Q_1$. Implicit in $I_R$ and $J_R$ is na:a, the emitter area ratio of the devices.

$$A_R \text{ Calculate } A_R = 1 + \frac{(kT/q)\ln J_R}{V_G - V_{BE0}}$$

Then:

$$R_1 = V_{BEO}/i_1$$

$$R_2 = (N-1)\ R_1$$

$$R_3 = (V_T - N\ V_{BEO})/(i_2 + i_1)$$

$$R_4 = I_R\ R_2$$

$$R_5 = I_R\ R_1$$

$$R_6 = \frac{R_4 + R_5}{\dfrac{R_1 + R_2 + R_3}{R_3} - A_R}$$

$$R_7 = (A_R - 1)\ R_6$$

$$R_8 = \frac{R_4}{N}\left[\frac{1}{1 + \dfrac{kT/q}{(V_G - V_{BE0})}} - \frac{1}{A_R + \dfrac{kT/q}{(V_G - V_{BE0})}}\right]$$

The current chosen for the $R_1$, $R_2$ string relates to error due to base current and $\beta$. The smaller the standing current in $R_1$, the larger the effect of the actual base current of $Q_2$ will be in $R_2$. This error can be compensated, but the smaller it is, the less residue there will be after compensation.

The bias in the $R_1/R_2$ string shows up at the emitter $Q_2$ and disturbs the PTAT current which ordinarily flows in band-gap transistors. In ordinary circuits, the current in the transistor would be the total emitter-resistor ($R_3$) current. In this circuit, the current in $R_1$ also flows in $R_3$. As a result, if the voltage at the emitter of $Q_2$ is proportional-to-absolute-temperature (PTAT) with respect to common, the current in $Q_2$ will not be PTAT. This can be treated by noting that the Thevenin equivalent (see also FIG. 4) of the drive to the $Q_2$ emitter can be calculated in the absence of $Q_2$ as a voltage proportional to $V_{DD}$ and scaled by $R_3/(R_1+R_2+R_3)$ and a source impedance $(R_1+R_2)R_3/(R_1+R_2+R_3)$. In this circuit, the voltage across $R_3$ is approximately PTAT and the emitter current of $Q_2$ is a somewhat "stronger" function of absolute temperature.

Once $i_1$ has been selected, $R_1$ is given by $R_1=V_{BEO}/i_1$ where $V_{BEO}$ is the nominal value for $Q_2$ under the temperature and emitter current conditions assumed for the design center. Next, the determination of the $V_{BE}$ multiplication factor N is in accordance with the principles described hereafter.

It is known that the base-emitter voltage can be determined as follows:

$$V_{BE} = V_{GO} - (V_{GO} - V_{BEO})T/T_O + (kT/q)\ln I/I_O + (mkT/Q)\ln T_O/T$$

For analysis purposes, it is appropriate to neglect the current-dependent terms, so that $V_{BE}$ will be set equal to $V_{GO}-(V_{GO}-V_{BEO})T/T_O$. Thus a component of $V_{BE}$ rises with falling temperature to the value of $V_{GO}$ (the extrapolated band-gap voltage) when T=0 Kelvin. Extrapolating this behavior for $V_{BE2}$, the voltage across $R_1$ will be $V_{GO}$ at 0 and the voltage from $V_{DD}$ to the $Q_2$ emitter will be N $V_{GO}$ where $$N = 1 + R_2/R_1.$$

Figure 3:
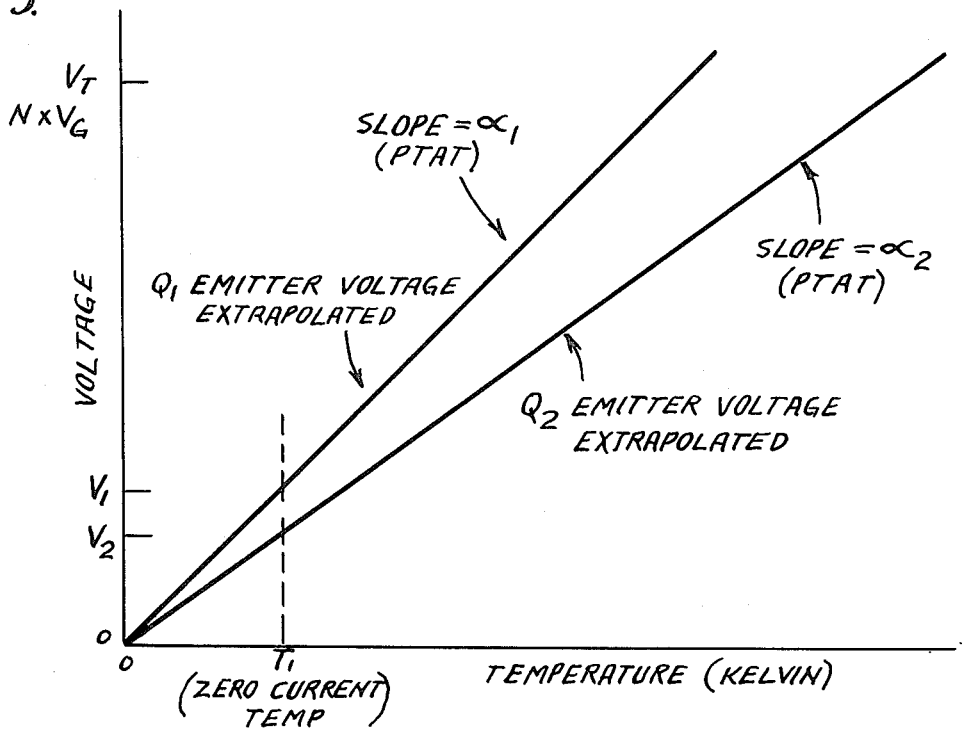
FIG. 3 is a graph to aid in explaining the operation of the invention.

With $V_{DD}$ equal to the desired $V_T$ at the design center, and placing $N=V_T/V_{GO}$, the emitter of $Q_2$ will be at 0 volts at 0 Kelvin. (In this expression, $V_G$ represents the value of $V_{GO}$ for the particular transistor characteristic involved, with the temperature behavior of $V_{BE}$ linearized around room temperature.) The transistor current is proportional to temperature, but with an offset to some positive temperature. That is, if the emitter voltage of $Q_2$ behaved at low temperatures as the extrapolation from room temperature in FIG. 3 indicates, the current would go through zero and reverse as the emitter voltage crossed the open circuit voltage. The temperature at which this happens is the offset. For temperatures far above the offset, emitter current rises a bit faster than PTAT. N can be selected so that the behavior of the $Q_2$ emitter voltage will be as shown in FIG. 3.

The current in $Q_1$ is maintained as a constant fraction of that in $Q_2$. This may not be necessary for satisfactory operation but it linearizes a $\Delta V_{BE}$ so as to permit simplified analysis.

With the current density in $Q_1$ a fixed fraction of that in $Q_2$, $Q_1$'s emitter voltage can also be extrapolated to zero at 0 Kelvin, with the same N factor in its base circuit. At any other temperature, the extrapolated emitter voltage of $Q_1$ will be higher than $Q_2$ due to $Q_1$'s lower current density. The voltage at $Q_1$ emitter is tapped by the divider $R_6$ and $R_7$ to produce a voltage equal to the $Q_2$ emitter voltage. Since the voltages at the emitter are PTAT (if $V_{DD}=V_T$), a fixed fraction of the $Q_1$ emitter voltage will equal the $Q_2$ emitter voltage.

If $V_{DD}$ changes from $V_T$, however, these voltages will not stay equal. For example, consider that if $V_{DD}$ goes up a little, the two emitter voltages will follow $V_{DD}$ with almost unity gain, since the transistors act somewhat like emitter followers driven by $V_{DD}$. Therefore the voltage changes at the two emitters will be near equal. However, the voltage change at Y will be attenuated by the voltage divider $R_6$, $R_7$. So, if $V_{DD}$ goes up, the voltage at X will rise more than the voltage at Y.

Once N is determined, $R_2$ is easily calculated as $(N-1)R_1$. Moreover, the emitter voltage of $Q_2$ will be $V_T-N\ V_{BEO}$ at the design center, and the current in $R_3$ will simply be the current from $R_1$ plus the emitter current of $Q_2$. This ratio gives the value for $R_3$.

Figure 4:
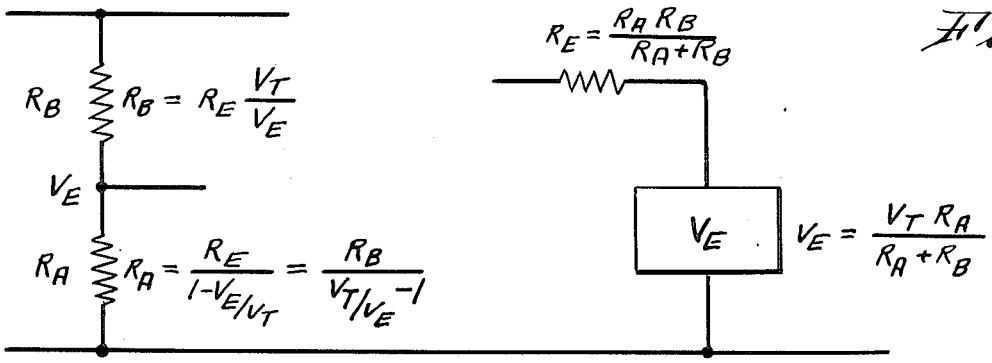
FIG. 4 shows an equivalent circuit based on Thevenin's theorem.

Once these three resistances are known, the Thevenin equivalent can be worked out as illustrated in FIG. 4. The open circuit voltage (see FIG. 3) $V_2$ will be $V_TR_3/(R_1+R_2+R_3)$ and the source resistance $R_{E2}$ will be $(R_1+R_2)R_3/(R_1+R_2+R_3)$. The corresponding temperature, $T_1$, is the temperature at which the emitter current of $Q_2$ would fall to zero if the voltage followed the extrapolation all the way down. At higher temperatures, the emitter current will increase in proportion to temperature (not absolute temperature however). If the current in $Q_1$ is to be proportional, it must fall to zero at $T_1$ also. Since $Q_1$ operates at a different current density (in the limit as i goes to zero), the voltage at $Q_1$'s emitter will be different from $Q_2$'s.

To find this voltage, reference may be made to FIG. 3 where it is seen that both emitter voltages are PTAT. That is, the emitter voltages are proportional to temperature by some constant $\alpha=N(V_G-V_{BEO})/T_O$. At temperature $T_1$ the voltage is just $\alpha T_1$ so that the ratio of $V_1/V_2$ is just the ratio $\alpha_1/\alpha_2$. Using the subscripted Q numbers:

$$\alpha_1/\alpha_2 = (N(V_G - V_{BE10})/T_0)/N(V_G - V_{BE20})/T_0)$$
$$= (V_G - V_{BE10})/(V_G - V_{BE20})$$

The ratio of the emitter currents will be held constant and the area ratio will remain fixed so that the current density ratio $J_R$ will also be fixed. As a result:

$$V_{BE1}=V_{BE2}-(kT/q)\ln J_R$$

at all temperatures so that $A_R$, the ratio of the $\alpha$'s is given by:

$$A_R\alpha_1/\alpha_2=1+(kT/q)\ln J_R/(V_G-V_{BEO})$$

where $V_{BEO}$ replaces $V_{BE20}$.

Then, $V_1=A_RV_2$. That is, the open circuit voltage at $Q_1$'s emitter should be $A_R$ times that for $Q_2$.

The actual current in $Q_1$ at some temperature T above $T_1$ will be given by $\alpha_1(T-T_1)/R_{E1}$, where $R_{E1}$ is the equivalent source resistance, as in $Q_2$ it is given by $\alpha_2(T-T_1)/R_{E2}$.

To maintain $J_R$ constant, with a constant emitter area ratio, $I_R$ the ratio of emitter currents must be constant. Thus:

$$\alpha_1(T-T_1)\, I_R/R_{E1}=\alpha_2(T-T_1)/R_{E2}$$

and:

$$R_{E1}=I_R(\alpha_1/\alpha_2)\, R_{E2}=I_R\, A_R\, R_{E2}$$

FIG. 4 includes expressions to derive resistor values for a divider from their desired Thevenin equivalent. Given the desired $V_2$ as $V_E$ and $R_{E1}$ as $R_E$, the value of $R_B=(R_4+R_5)$ and $R_A=(R_6+R_7)$ can be found:

$$R_B=R_{E1}\, V_T/V_1$$

but, $$R_{E1}=I_R\, A_R\, R_{E2} \text{ and } V_1=A_RV_2$$

so:

$$R_B=I_R\, R_{E2}\, V_T/V_2$$

By applying the expressions of FIG. 4 to $R_1$ and $R_2$:

$$R_1+R_2=R_{E2}\, V_T/V_2$$

and:

$$R_B=I_R(R_1+R_2)$$

Since the ratio between $R_5$ and $R_4$ should be the same, $(N-1)$, as between $R_1$ and $R_2$ it follows that:

$$R_4=I_R\, R_2, \qquad R_5=I_R\, R_1$$

To get the lower half of the resistance at $Q_1$'s emitter, the expression from FIG. 4 can be employed:

$$R_A = \frac{R_B}{\frac{V_T}{V_E} - 1}$$

Substituting $V_1=A_R\, V_2$ for the desired voltage $V_E$:

$$R_A = \frac{R_B}{\frac{V_T}{A_RV_2} - 1}$$

At balance, when $V_{DD}=V_T$ and $X-Y=0$ the voltage at Y should equal the emitter voltage of $Q_2$. That means that the voltage which appears across $R_6+R_7=R_A$ is $A_R$ times the voltage on $R_6$, or:

$$R_A=A_RR_6$$

and combining with the above:

$$R_6 = \frac{R_B}{\frac{V_T}{V_2} - A_R}$$

Substituting in the value just determined for $R_B$ and the resistor ratio which gives $V_T/V_2$ gives the result:

$$R_6 = \frac{R_4 + R_5}{\frac{R_1 + R_2 + R_3}{R_3} - A_R}$$

Finally, since:

$$R_A=R_6+R_7=A_R\, R_6$$

Then:

$$R_7=(A_R-1)R_6$$

The above analysis is substantially complete, neglecting only base current, $V_{BE}$ curvature, and $I_c$ being proportional to an offset temperature. The last two effects are fairly small and tend to oppose each other in any event.

Several of the external constraints make it desirable to use large values for $R_1$ and dependent resistances. In this case, low $\beta$ transistors will produce an error in the threshold. Roughly, the base current of $Q_2$ flowing in $R_2$ will produce an extra drop which will add directly to $V_T$. The voltage on $R_4$ will be similarly affected by the base current of $Q_1$ to the extent that $\beta_2=\beta_2$.

To the extent that the betas do not match, a further threshold offset will be produced. This is because a small difference voltage will be produced between X and Y which will have to be compensated by an additional change in $V_T$.

This effect can be exploited to make a first order compensation for the primary base current error. The addition of $R_8$ in the base circuit of $Q_1$ will drop the emitter voltage an extra $NR_8i_{b1}$. To balance this drop the threshold will have to come down by a factor related to the "gain" of the circuit, i.e. the change in voltage between X and Y as $V_{DD}$ departs from $V_T$. The inverse of this gain times the $NR_8i_BI$ factor should be made equal to the $R_2$ $i_{b2}$ term assumed to equal $R_4$ $i_{bi}$. That is:

$$R_8 = \frac{R_4 G}{N}$$

Figure 5:
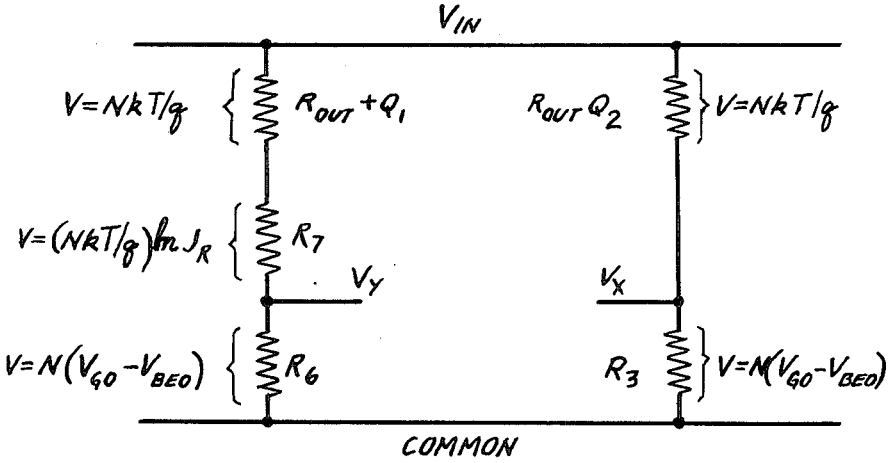
FIG. 5 is another circuit diagram illustrating aspects of the operation of the circuitry.

The gain factor G can be derived, approximately, from FIG. 5. By treating the transistors as their equivalent emitter source impedance driving point X and Y the small signal gain can be determined from the ratio of some voltages. On the right, the emitter impedance of $Q_2$ is approximated by $NkT/qi_E$. This impedance works against $R_3$ to attenuate at X signals applied to $V_{in}$ which corresponds to $V_{DD}$. Since they share a common current, $I_E$, the ratio of these impedances is just the ratio of the respective voltage drops. On the left a similar situation exists for $Q_1$ except that there is an additional voltage drop across $R_7$ which further attenuates $V_{in}$ at point balance and the voltage across $R_7$ is just $A_R-1$ times that across $R_6$ (from the synthesis and the fact they share the same current). Then if $G+(V_X-V_Y)/V_{in}$ $$G = \frac{N(V_G - V_{BE0})}{NkT/q + N(V_G - V_{BE0})} - \frac{N(V_G - V_{BE0})}{NkT/q + N(A_R - 1)(V_G - V_{BE0}) + N(V_G - V_{BE0})}$$

$$G = \frac{1}{\frac{kT/q}{V_G - V_{BE0}} + 1} - \frac{1}{\frac{kT/q}{V_G - V_{BE0}} + A_R}$$

This expression, when multiplied by $R_4/N$ gives the result shown for $R_8$ in the earlier listing.

By way of example, the following circuit values were determined by the procedures developed hereinabove:

| |
|---|
| $R_1$ = 6.68K |
| $R_2$ = 19.33K |
| $R_3$ = 7.16K |
| $R_4$ = 193.3K |
| $R_5$ = 66.8K |
| $R_6$ = 76.2K |
| $R_7$ = 16.57K |
| $R_8$ = 11K |
| $V_{DD}$ = 4.72 V |

The calculations for circuit values are based on the assumption that the transistors have the same beta, but the different current densities in the transistors results in slightly different betas. Because of this difference, and possibly other factors, the optimal circuit values, e.g. as determined by circuit simulation, may differ somewhat from those developed above.

Figure 2:
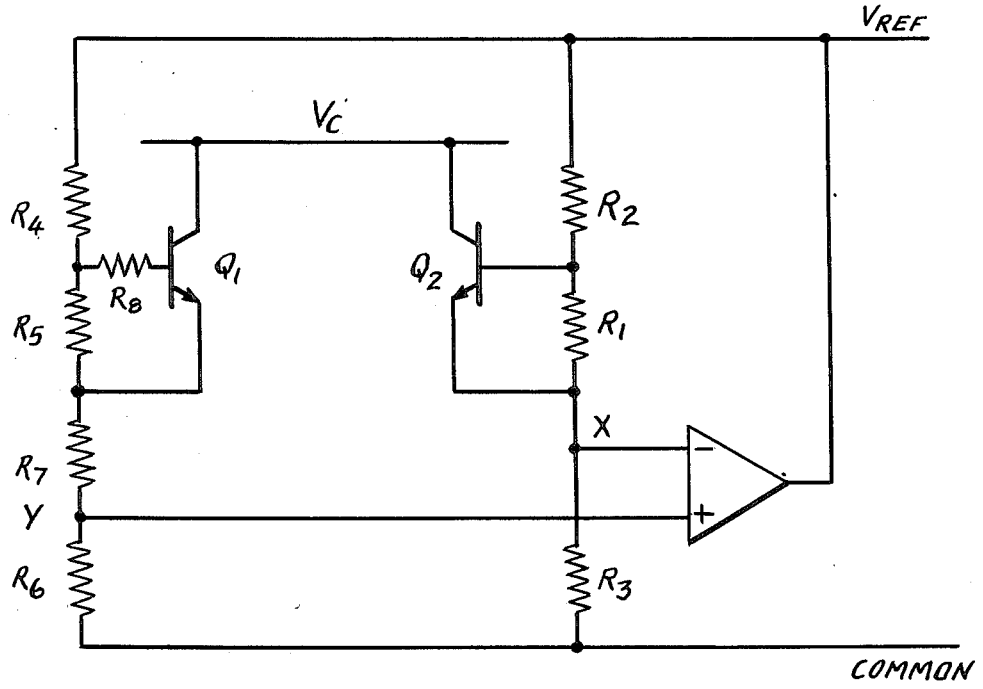
FIG. 2 is a circuit diagram showing another embodiment of the invention for use as a voltage reference.

Another embodiment of the invention is shown in FIG. 2. Here the circuit of FIG. 1 is operated closed loop to stabilize rather than detect a particular reference voltage. For this purpose there is provided an amplifier having its input connected to the output terminals X–Y. Any differehce is amplified and applied to the $V_{REF}$ line, which is the voltage to be stabilized. The amplifier is connected for negative feedback so that $V_{REF}$ will be driven to minimize the X–Y voltage difference.

The voltage $V_C$ to which the transistor collectors are returned is independent of $V_{REF}$. This voltage $V_C$ may be positive, negative, or the same as $V_{REF}$ (and may even be different for the two transistors). It is an important advantage that the collectors are uncommitted. It is particularly advantageous because the substrate bipolar transistors (parasitic) developed in the usual CMOS processes can be employed as the reference circuit transistors. Although the circuit is shown implemented with NPN transistors, it could use PNP transistors, such as might be found on an N-well CMOS process.

The $V_{REF}$ line can be biased beyond (i.e. positive in FIG. 2) the $V_C$ line so that the circuit can actually control the regulation of a voltage beyond its supply rails. This arrangement would take advantage of thin film resistors and the fact that the $V_{REF}$ voltage is divided down before being applied to the transistors, resulting in the multiplication of the $\Delta V_{BE}$ signal associated with the X–Y difference voltage. This circuit does not have the headroom problem in some previous proposals, and is not constrained to use integral multiples of the band gap. The amplifier can directly drive the $V_{REF}$ terminal so that it not only stabilizes the loop voltage, but it also can provide a low impedance output.

Although preferred embodiments of the invention have been disclosed herein in detail, it is to be understood that this is for the purpose of illustrating the invention, and should not be construed as necessarily limiting the invention since those of skill in this art can readily make various changes and modifications thereto without departing from the scope of the invention as reflected in the claims hereof.

What is claimed is:

1. A band-gap reference circuit comprising:

first and second transistors operable at different current densities to produce a $\Delta V_{BE}$ signal as a function of temperature;

first and second $V_{BE}$ multiplier circuits each connected to the base and emitter of a corresponding one of said transistors; and output terminal means coupled to said transistors to develop a $\Delta V_{BE}$ signal multiplied in magnitude by said multiplier circuits.

2. A circuit as in claim 1, wherein each of said multiplier circuits comprises at least two series-connected resistors one of which is connected between the base and emitter of the corresponding transistor.

3. A circuit as in claim 2, including first and second resistor means connected between common and the emitter of a respective transistor;

one of said resistor means comprising at least two resistors forming a voltage divider to establish at the junction of said two resistors one terminal of said output terminal means.

4. A circuit as in claim 1, wherein each of said multiplier circuits includes first resistive means connected between the base of the corresponding transistor and a reference voltage, and second resistive means connected between the base and the emitter of the corresponding transistor.

5. A circuit as in claim 4, including first and second emitter resistor means each connected between a common line and the emitter of a corresponding transistor.

6. A circuit as in claim 5, wherein one of said emitter resistor means comprises at least two series-connected resistors forming a voltage divider;

said output terminal means having one terminal at the junction between two of said series-connected resistors;

said output terminal means having a second terminal connected to the emitter resistor means.

7. A circuit as in claim 1, wherein said multiplier circuits are connected to a voltage reference line to produce current therethrough;

an amplifier having its input connected to said output terminal means to receive the signal therefrom; and means connecting the output of said amplifier to said voltage reference line in a negative feedback sense to stabilize the voltage of said line.

8. A circuit as in claim 7, wherein each of said multiplier circuits comprises a resistor string;

one end of each string being connected to said voltage reference line;

the other end of each string being connected to the emitter of a respective one of said transistors;

the base of each of said transistors being connected to an intermediate junction of a corresponding one of said resistor strings.

9. A circuit as in claim 8, including two series resistors connected between common and the emitter of one of said transistors;

at least one resistor connected between common and the emitter of the other transistor;

said amplifier input being connected between the emitter of said other transistor and the junction of said two series resistors.

10. A circuit as in claim 7, wherein the collectors of said transistors are connected to voltages which are different from the voltage of said reference line.

* * * * *

UNITED STATES PATENT AND TRADEMARK OFFICE

CERTIFICATE OF CORRECTION

PATENT NO. : 4,622,512

DATED : November 11, 1986

INVENTOR(S) : Adrian Paul Brokaw

It is certified that error appears in the above—identified patent and that said Letters Patent is hereby corrected as shown below:

Column 5, line 31 should read:

$$A_R = \alpha_1/\alpha_2 = 1 + (kT/q)\ln J_R/(V_G - V_{BEO})$$

Signed and Sealed this

Seventeenth Day of February, 1987

*Attest:*

DONALD J. QUIGG

*Attesting Officer*

*Commissioner of Patents and Trademarks*